US006516592B1

(12) United States Patent
Kimmerle

(10) Patent No.: US 6,516,592 B1
(45) Date of Patent: Feb. 11, 2003

(54) PACKAGING APPARATUS

(75) Inventor: Andreas Kimmerle, Hoechststaedt (DE)

(73) Assignee: ErgoPack Deutschland GmbH (DE)

( * ) Notice: Subject to any disclaimer, the term of this patent is extended or adjusted under 35 U.S.C. 154(b) by 0 days.

(21) Appl. No.: 09/544,812

(22) Filed: Apr. 7, 2000

(51) Int. Cl.[7] ..... B65B 13/04

(52) U.S. Cl. ..... 53/589; 53/592; 53/390; 53/588; 100/27; 100/26

(58) Field of Search ..... 53/589, 390, 592, 53/588; 100/27, 28, 26, 25

(56) References Cited

U.S. PATENT DOCUMENTS

| | | | | |
|---|---|---|---|---|
| 3,213,781 A | * | 10/1965 | Collins | 100/26 |
| 3,279,354 A | * | 10/1966 | Dickens | 100/26 |
| 3,613,557 A | | 10/1971 | Coleman | |
| 3,701,314 A | * | 10/1972 | Tull, III | 100/28 |
| 3,899,963 A | * | 8/1975 | Tremper | 100/25 |
| 4,106,403 A | * | 8/1978 | Sutehall | 100/25 |

FOREIGN PATENT DOCUMENTS

| | | |
|---|---|---|
| DE | 30-30-520 A1 | 3/1982 |
| DE | 28-53-440 C2 | 5/1983 |
| DE | 298-08-111 U1 | 10/1998 |

* cited by examiner

*Primary Examiner*—Rinaldi I. Rada
*Assistant Examiner*—Louis Tran
(74) *Attorney, Agent, or Firm*—M. K. Silverman

(57) ABSTRACT

An apparatus, in particular an apparatus which can be manually operated and transported, being provided for the purpose of strapping and/or bundling pallets and articles with at least one base plate, with a band-leading device and with at least one clamping device arranged at the front end of the band-leading device. A guiding device, in which the band-leading device is guided, is provided on the base plate. A carriage, which has a deflecting unit, is releasably attached to the front end of the band-leading device. On the carriage there is fastened a length-limiting band, which can be fixed in a number of regions of the base plate.

20 Claims, 5 Drawing Sheets

B

PACKAGING APPARATUS

Figure 1:
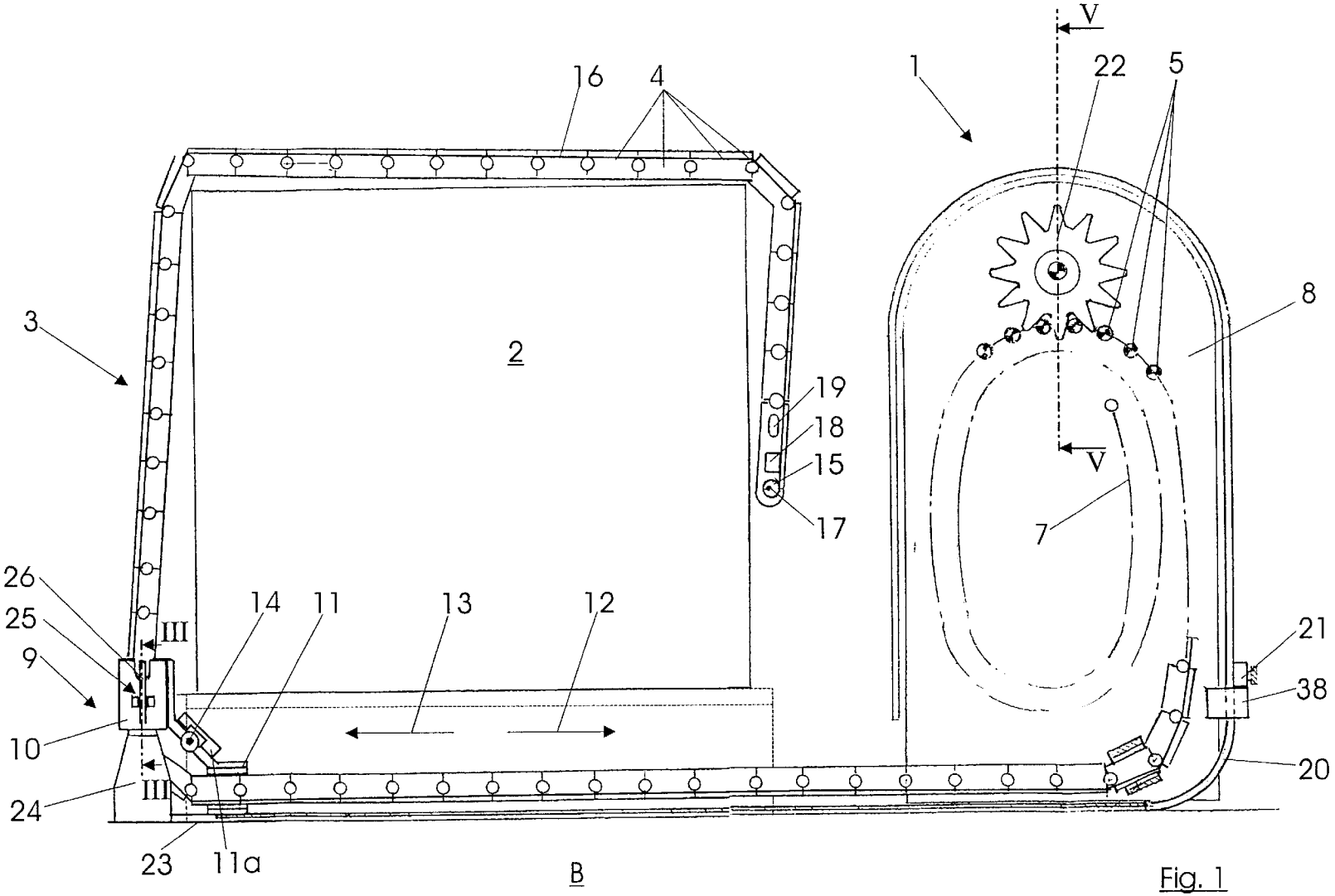

The invention concerns an apparatus, in particular a manual and transportable apparatus, for strapping and/or bundling articles, having at least one base plate, having a rigid-backed chain and having at least one clamping device arranged at the front end of the rigid-backed chain.

Packages or articles are generally fastened on pallets by means of a packaging band in order to ensure that these packages or articles are transported securely and without being damaged.

In the manual strapping of packages or individual items placed on pallets by means of bands, it is necessary for the band to be passed through a gap between the package or item and the ground. Since these bands behave like a rope when they are pushed, passing them through is particularly problematical. Particularly in the case of relatively large packages or individual items, this operation is possible only with an auxiliary element. What is disadvantageous here is that, even with an auxiliary element, the operation is very time-consuming and a second person is often necessary for carrying out this task.

DE 298 08 111 U1 discloses a packaging machine of the generic type for strapping pallets with the aid of a rigid-backed chain.

What is disadvantageous about the packaging machine described there is that the operator of this packaging machine still has to walk around the article or package to be packaged in order to lift off the ground the band passed under the package with the aid of the rigid-backed chain, to be able then to strap the item completely. As before, this is relatively laborious and therefore time-intensive.

DE 30 30 520 A1 describes a method of tying up an article by means of a wire or band, in which the wire is passed around the article in a curved path.

The apparatus necessary for carrying out this method must be supplied with compressed air, as described in this document. That is to say, the apparatus must be virtually fixed in place in order to ensure that it is supplied with compressed air. This means that the articles or packages intended for strapping have to be transported to the apparatus, which entails not inconsiderable effort. This is also often difficult, since certain packages can scarcely be transported without being tied up.

DE 28 53 440 C2 shows a guiding channel of a tying apparatus with an elongate, flexible component. Since this apparatus likewise operates with a fluidic drive, this unit is also virtually fixed in place, with the result that it is also the case with this apparatus that the articles or packages to be packaged have to be transported to the apparatus.

Further stationary packaging or strapping apparatuses are disclosed in U.S. Pat. No. 3,899,963, U.S. Pat. No. 3,613,557, U.S. Pat. No. 3,279,354, U.S. Pat. No. 3,213,781 and in "Verpackungsberater" [packaging adviser], February 1975, page 82, reader service no. 189. The apparatuses described there are used mainly as part of a production line. The disadvantage of this apparatus is that it has to be supplied with power and has only restricted flexibility with respect to the size of package to be packaged, since the apparatuses enclose the package virtually completely and can package only packages of a certain size range.

It is therefore the object of the present invention to provide an apparatus for strapping packages which can be manually operated and transported and with which strapping of articles and packages of any size is possible in a way which is as quick and simple as possible.

This object is achieved according to the invention by the features stated in the defining part of claim 1.

The solution according to the invention makes it possible for a package or article of almost any size to be strapped or bundled quickly and in a simple way by just one person.

Since the apparatus is to be operated manually, it does not require any line-conducted power and, as a result, can be readily transported by one person to the article to be packaged. This is particularly advantageous, since transporting the article or package to a bundling apparatus at a fixed location is often not at all possible because the article to be bundled could be damaged as a result, owing to inadequate fixing on a pallet, or transporting to an apparatus at a fixed location entails not inconsiderable effort.

Furthermore, it is no longer necessary with the apparatus according to the invention for the user to walk around the package to be packaged, and furthermore the packaging band no longer has to lift off the ground, since the rigid-backed chain virtually leads the packaging band around the article to be bundled, which means that the packaging operation itself is simplified and consequently there is a not insignificant saving of time when carrying out the bundling operation.

A particularly reliable way of guiding the band-leading element in the guiding device is achieved by the guiding device provided in the base plate being made in the form of a T groove.

The T groove achieves secure and functionally reliable guidance of the rigid-backed chain in the same. Furthermore, it is relatively simple from production engineering aspects as well for the T groove to be provided in the base plate.

Particularly simple and likewise reliable guidance of the rigid-backed chain in the T groove is achieved by the rigid-backed chain being passed over a bolt in the guiding device, said bolt being provided with an incision on the circumference.

Secure deflection of the rigid-backed chain is ensured by the carriage having a locking mechanism for connecting and releasing the same with respect to the rigid-backed chain.

Furthermore, secure deflection is likewise achieved by a tripping cam being fastened on the front end of the rigid-backed chain, by which cam on the one hand the connection between the deflecting unit and the rigid-backed chain is released and on the other hand, on the way back, the rigid-backed chain is in turn connected to the deflecting unit of the carriage.

What is more, the deflection of the rigid-backed chain is ensured by the deflecting unit being connected pivotably to a pushing part of the carriage by means of a bolt arranged transversely with respect to the direction of movement of the rigid-backed chain.

Likewise contributing to a virtually automatic deflection of the band-leading device is the configuration that a lever mounted such that it can pivot about bolts arranged between its two ends is arranged on the deflecting unit.

This is achieved, inter alia, also by a blocking bolt being arranged pivotably at one end of the lever by means of a bolt.

As a result, the blocking bolt is held in its desired position, since the insert bolt has an attachment, over which a helical spring has been pushed.

Secure fixing of the deflecting unit and of the rigid-backed chain is ensured by a side wall of the deflecting unit having a bore arranged transversely with respect to the direction of movement of the rigid-backed chain as a guide for the blocking bolt, into which the blocking bolt can be pushed for locking the rigid-backed chain.

A trouble-free fixing operation between the deflecting unit and the rigid-backed chain is made possible by the rigid-backed chain being provided in its front region with a slot.

The automatic deflection of the rigid-backed chain around the package to be bundled is ultimately made possible by the deflecting unit being able to be connected to the rigid-backed chain by means of the bolt. Very simple and nevertheless reliable fixing of the band is achieved by the clamping device being designed as a self-clamping eccentric bolt.

The eccentric roller offers the advantage that it is very simple to produce. Furthermore, with this clamping device, the user only has to push the band past the clamping device, since with this clamping device the actual clamping operation proceeds virtually automatically, which in turn has the consequence of simplifying this operation and achieving a corresponding time saving.

A configuration which is simple in its construction and functions well and reliably consists in that the rigid-backed chain can be moved by means of a gearwheel, which engages in the intervals between the bolts arranged on the rigid-backed chain. A space-saving and simple possibility for a configuration of the apparatus according to the invention consists in that the T groove provided in the base plate follows a spiral-like path on the base plate.

Provision for secure deflection of the rigid-backed chain is made by the deflecting unit having a support fastened laterally on it, preventing the blocking bolt from coming out of the rigid-backed chain before deflection.

Canting or jamming of the carriage while it is being passed through between the ground and the article to be packaged is avoided by the pushing unit of the carriage having a skid part.

Canting or jamming of the carriage during this operation is further avoided by an end of the skid part pointing in the direction of the extending movement of the rigid-backed chain and an end of the skid part pointing in the direction of the retracting movement of the rigid-backed chain pointing away from the ground.

Consequently, even cross-bars of the pallet lying transversely with respect to the direction of movement of the carriage can be jumped over without any problem when the carriage is retracting or extending, without the carriage jamming between these individual cross-bars.

A favorable solution, particularly with respect to the wear and durability of the bolts necessary for guiding the rigid-backed chain in the guiding device, is achieved by the bolts being made from plastic.

By making the bolts from plastic, destruction of the bolts by rust, as would be the case with bolts made of steel, is avoided. As a result, these bolts perform their function for a relatively long time even under unfavorable environmental conditions, thereby achieving a low degree of wear overall.

Furthermore, the use of plastic has the effect of achieving a weight reduction, on account of the low density of this material, which contributes to better manual transportability of the complete apparatus.

The weight reduction also has the effect of preventing the rigid-backed chain from canting away in one direction in an uncontrolled manner, on account of having a high weight of its own. Consequently, this weight reduction ultimately leads to a better functional capability of the rigid-backed chain and consequently also of the complete apparatus.

A configuration of the device that is advantageous particularly with respect to weight is achieved by the base plate being formed from plastic.

The use of plastic has the effect of achieving a considerable weight reduction, on account of the low specific density of said material, which, for the apparatus to be transported manually, has the consequence of making it significantly easier for the operator to transport it.

Furthermore, the use of plastic allows the base plate to be produced particularly cost-effectively and simply.

What is more, the use of plastic for the base plate and the bolts guided in the T groove of the base plate has the effect of providing a combination of materials which are particularly good for sliding on one another on account of their properties, which has the result that the rigid-backed chain can move easily and with low wear in the T groove of the base plate.

Secure and reliable running during the retracting and extending movement of the rigid-backed chain in the guiding device is achieved by the guiding device having a conically tapering retracting region and extending region.

This configuration allows the carriage to be extended at different heights, since the rigid-backed chain is no longer guided in a fixed path but rather in a certain region in the extending and retracting regions, and the carriage is consequently flexible with respect to its extending height or the distance of the carriage from the ground.

Figure 2:
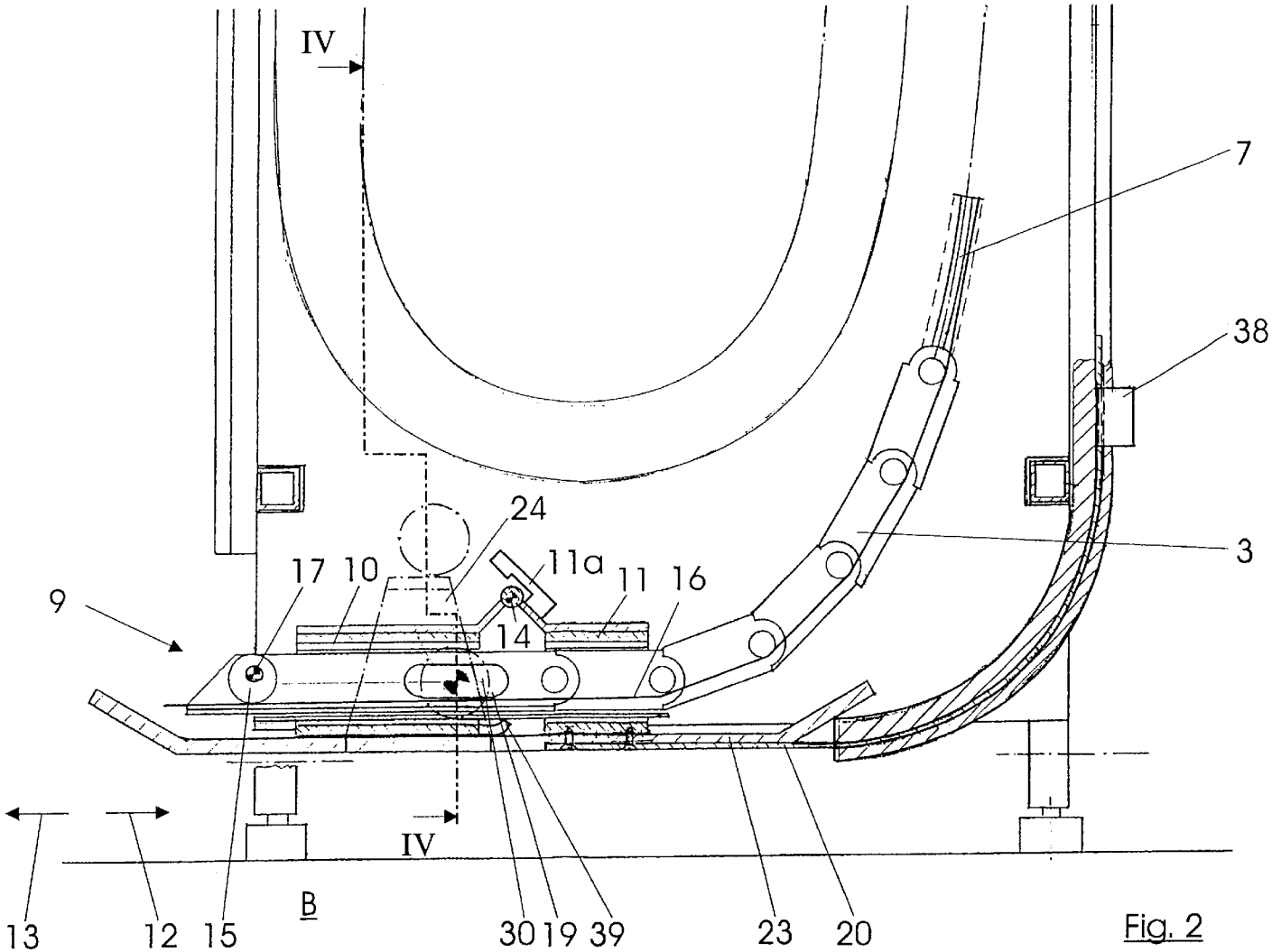
Figure 3:
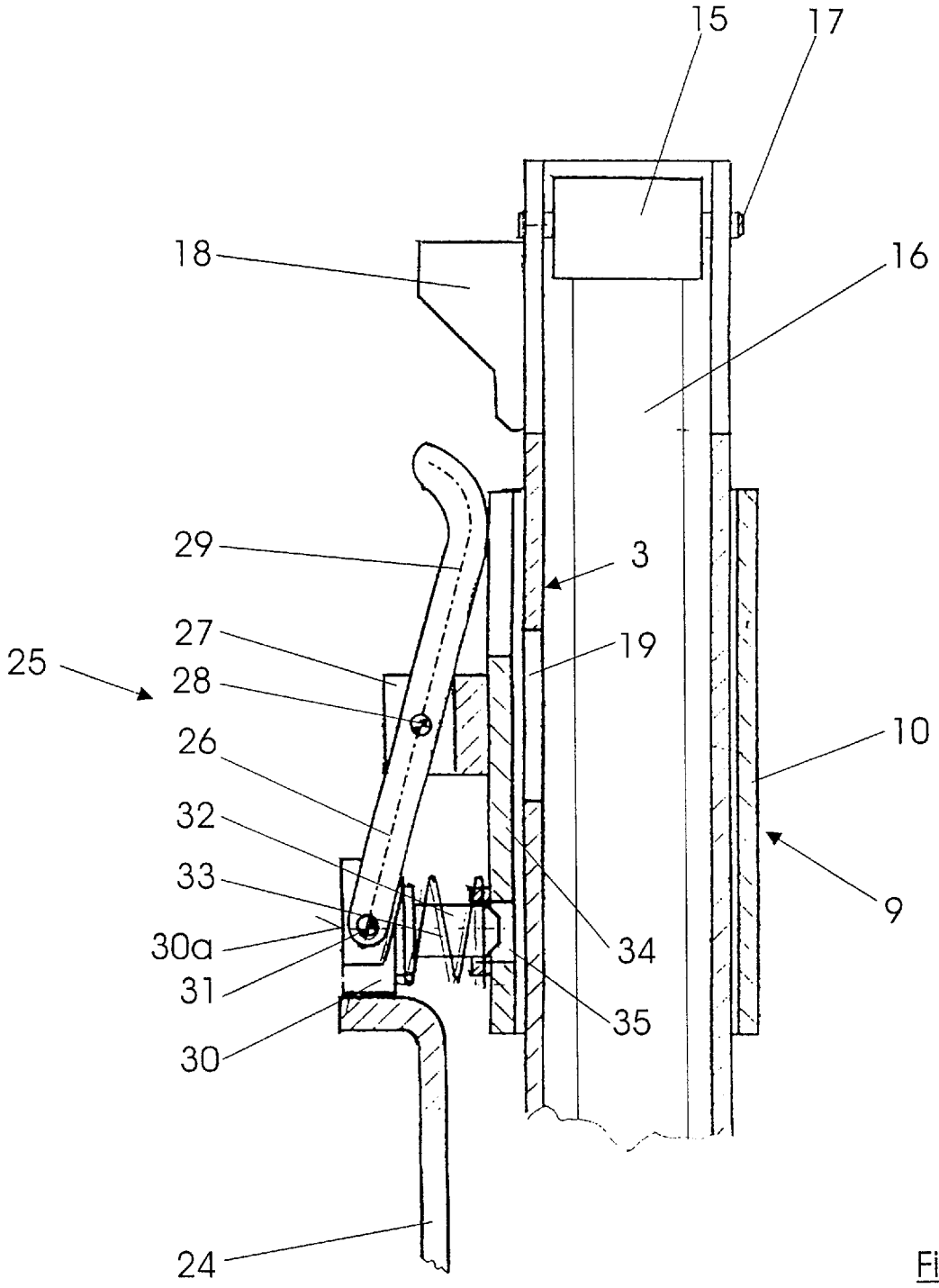
Figure 4:
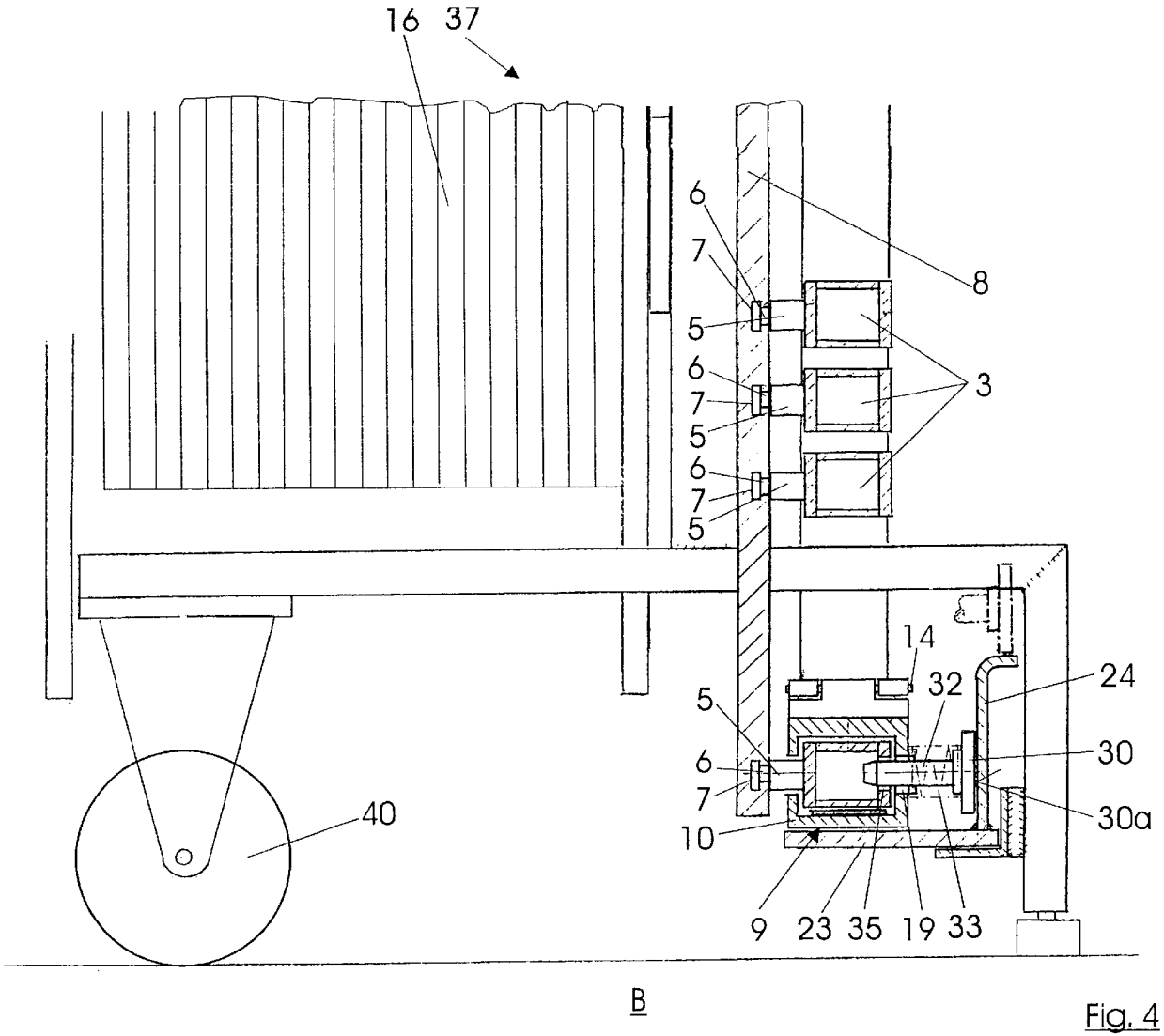
Figure 5:
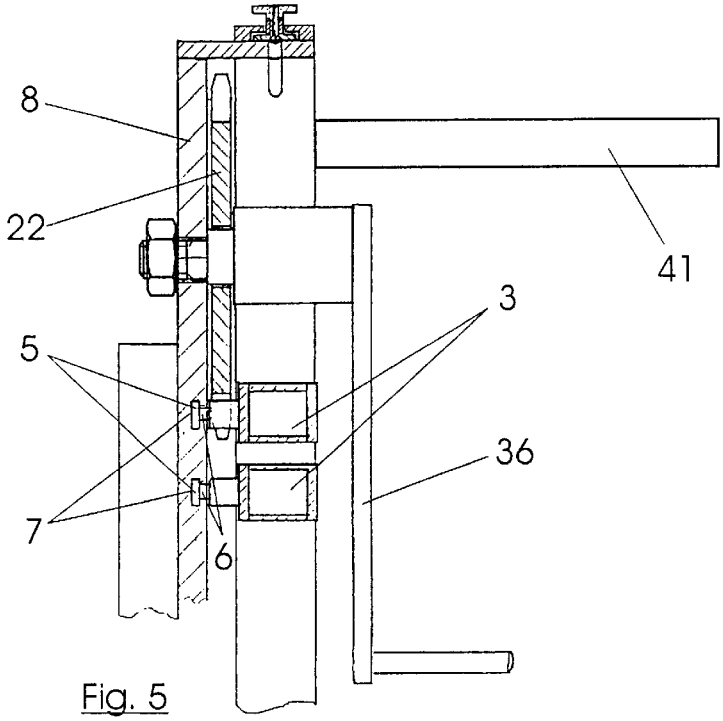
Figure 6:
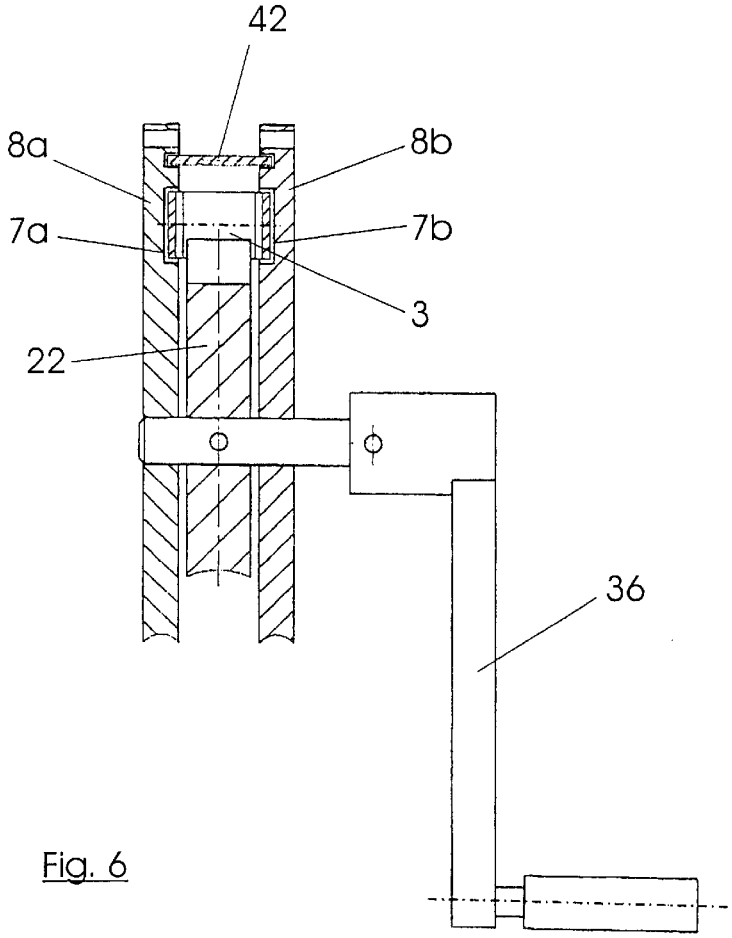

An exemplary embodiment of the invention is described in principle below, with reference to the drawing, in which:

FIG. 1 shows a schematic representation of an apparatus during the bundling operation, FIG. 2 shows an enlarged representation of the apparatus in the region near the ground in the unused state, in particular a section through a carriage, FIG. 3 shows an enlarged sectional representation along the line III—III from FIG. 1 of the carriage in the deflected state, FIG. 4 shows a section through the apparatus in the region near the ground along the line IV—IV from FIG. 2, FIG. 5 shows a section through the apparatus in the region away from the ground along the line V—V from FIG. 1, and FIG. 6 shows a section through the apparatus in the region away from the ground, similar to the section according to FIG. 4, in a different configuration.

Represented in FIG. 1 is an apparatus 1 for bundling packages or articles 2 placed on pallets or the like, during the bundling operation. Furthermore, FIG. 1 shows a band-leading device 3, which is preferably formed as a rigid-backed chain, which in turn comprises a multiplicity of links 4, the links 4 being releasable from the rigid-backed chain 3 with relatively little effort. The rigid-backed chain 3 is guided by means of the bolts 5, which are only indicated in FIG. 1 and are provided with an incision 6 on the circumference of the bolt 5, in a guiding device 7, which is provided in a base plate 8 of the apparatus 1. The bolts 5 consist of plastic and are provided directly on the rigid-backed chain 3.

Also represented in FIG. 1 is a carriage 9, which comprises a deflecting unit 10 and a pushing part 11, in the deflecting position. In this position, the deflecting unit 10 has been pivoted through approximately 90° with respect to its normal position about a bolt 14, which is arranged transversely with respect to the direction of the retracting movement (arrow 12) and direction of the extending movement (arrow 13) and forms the pivot point. By means of this bolt 14, the deflecting unit 10 of the carriage 9 is connected positively and pivotably to the pushing part 11 of the carriage 9. At an end of the rigid-backed chain 3 at the front in the direction of the extending movement (indicated by arrow 13) there is arranged a clamping device 15, by means of which a packaging band 16 is fixed on the rigid-backed chain 3 before the beginning of the bundling operation. The clamping device 15 is in this case preferably designed as a self-clamping eccentric bolt, which is pivotably mounted by means of a bolt 17 arranged transversely with respect to the direction of movement (arrow 12 and arrow 13) of the rigid-backed chain 3 but not represented in any more detail.

What is more, the rigid-backed chain 3 has at this end a tripping cam 18, fixedly connected to the rigid-backed chain 3, and furthermore a slot 19, arranged in the rigid-backed chain 3.

Also to be seen in FIG. 1 is a length-limiting band 20, which on the one hand is fastened on the pushing part 11 of the carriage 9 and on the other hand can be fixed in the region of the base plate 8 of the apparatus 1 by means of a stop 21 fastened on the length-limiting band.

Furthermore, FIG. 1 shows a gearwheel 22, which engages with its teeth in the bolts 5 of the rigid-backed chain 3 and, as a result, makes an extending movement or a retracting movement of the rigid-backed chain 3 possible by the drive of the gearwheel 22.

FIG. 2 shows an enlarged representation of the region near the ground of the apparatus 1. The carriage 9 is in this case to be seen in a longitudinal section, along the direction of movement (arrow 12 and arrow 13) of the rigid-backed chain 3. Fastened in this case on the pushing part 11 of the carriage 9 is a skid part 23, the two ends of which, lying in the direction of the retracting movement (arrow 12) and in the direction of the extending movement (arrow 13), are designed such that they point away from the ground. This has the advantage that canting or jamming of the carriage 9 is prevented during the extending movement (arrow 13) and during the retracting movement (arrow 12), since the skid part 23 compensates for unevennesses of the ground B on which the carriage 9 is moved.

Furthermore, this configuration makes it possible for pallet cross-bars (not represented), lying transversely with respect to the direction of movement 12, 13 of the carriage 9, to be run over or jumped over quite readily, without the carriage 9 jamming or canting as it does so.

What is more, fastened on the skid part 23 is a support 24 (indicated by dash-dotted lines), which is arranged laterally on the carriage 9, in parallel and in the direction of movement. The length-limiting band 20 is also fastened on the carriage 9 by means of the skid part 23. The position of the carriage 9 that is represented in FIG. 2 corresponds to the normal position of the carriage 9.

It can also be seen in FIG. 2 that the rigid-backed chain 3 has been passed virtually through the carriage 9, in other words through the deflecting unit 10 and the pushing part 11. In this position of the carriage 9, the rigid-backed chain 3 is connected to the carriage 9 by means of a locking mechanism 25, not represented in this figure.

FIG. 3 shows an enlarged representation of the carriage 9, in particular of the deflecting unit 10 and of the locking mechanism 25, in the deflected position, i.e. during the bundling operation. The locking mechanism 25 has a lever 26, mounted such that it can pivot between its two ends. The pivot mounting of the lever 26 is realized in this case by means of a bolt 28 fastened on a supporting joint 27, the supporting joint 27 in turn being fastened on the deflecting unit 10 of the carriage 9. The end of the lever 26 pointing in the direction of movement (arrow 13) is bent in this case through approximately 90° with respect to the longitudinal axis 29 of the lever. It goes without saying that this end of the lever 26 may also be straight. Arranged at the other end of the lever 26 is a blocking bolt 30, by means of a further bolt 31 on the lever 26. The blocking bolt 30 has an attachment 32, onto which a helical spring 33 has been pushed. The helical spring 33 is designed in this case as a compression spring. This compression spring 33 presses the blocking bolt 30 transversely with respect to the direction of movement (arrow 12 and arrow 13) of the rigid-backed chain 3, away from the same. Furthermore, it can be seen in FIG. 3 that, in this position of the carriage 9, the blocking bolt 30 rests on the support 24 and consequently holds the deflecting unit 10 in this position.

Represented in FIG. 4 is a side view in the region near the ground of the apparatus 1, in a section along the line IV—IV from FIG. 2, in the normal position. Also to be seen in FIG. 4 is a section transverse with respect to the direction of movement of the rigid-backed chain 3 through the carriage 9, in particular through the deflecting unit 10. The blocking bolt 30, arranged on the lever 26 (not to be seen in this figure) has in this position of the carriage 9 been inserted through a bore 35, provided in the side wall 34 of the carriage 9, and through the slot 19 provided in the rigid-backed chain 3, whereby the deflecting unit 10, and consequently also the carriage 9, is connected or locked to the rigid-backed chain 3. The guiding device 7, which is made in the form of a T groove and in which the bolts 5 which are fastened on the rigid-backed chain 3 are guided, can also be seen in FIG. 4. Also to be seen in FIG. 4 is the position of the blocking bolt 30 which the latter assumes in the deflecting position (indicated by a dash-dotted line).

Represented in FIG. 5 is the region away from the ground of the apparatus 1 in a lateral sectional representation along the line V—V from FIG. 1. Represented inter alia is a hand crank 36, on which the gearwheel 22 is provided. FIG. 5 also shows how the gearwheel 22 engages in the bolts 5 which are fastened on the rigid-backed chain 3. The movement of the hand crank 36, and consequently also of the gearwheel 22, makes it possible to move the rigid-backed chain 3 along the guiding device 7 and, furthermore, to retract and extend the rigid-backed chain 3. In the unused state of the apparatus 1, the rigid-backed chain 3 is stored in the guiding device 7 in its entirety, i.e. in its entire length. The guiding device 7 follows a spiral-like path on the base plate 8 of the apparatus 1, as is indicated in FIG. 1, making it possible to store the entire length of the rigid-backed chain 3 in a relatively small space.

Represented in FIG. 6 is a lateral sectional representation of the upper region of the apparatus, similar to that according to FIG. 5, with a different configuration. As can be seen, in this case two base plates 8*a* and 8*b* are provided, connected to each other by means of spacers 42. Instead of lateral bolts 5, by means of which the rigid-backed chain 3 is guided in the groove 7 as a guiding device, now correspondingly enlarged grooves 7*a* and 7*b* have been milled spirally in the two base plates 8*a* and 8*b* as the guiding device. The two grooves 7*a* and 7*b* are in this case arranged mirror-invertedly with respect to each other, whereby the rigid-backed chain 3 is guided directly on both sides in the grooves 7*a* and 7*b*. The gearwheel 22 for driving the rigid-backed chain 3 is in this case arranged between the two base plates 8*a* and 8*b* and is also mounted on both sides in the base plates 8*a* and 8*b*.

The operation of bundling a package with the aid of the apparatus 1 is now described below.

Before the beginning of the actual bundling operation, the apparatus 1 is brought into a position alongside the article to be bundled. With the aid of the stop 21, which is fastened on the length-limiting band 20, it is possible to set different package sizes at specific distances before the bundling operation.

The packaging band 16 is passed by means of a band roller 37, represented only in FIG. 4, through a slit, not represented, located in the base plate 8 and is fastened at the front end of the rigid-backed chain 3 with the aid of the clamping device 15 on the rigid-backed chain 3. As soon as the fastening of the packaging band 16 on the rigid-backed chain 3 has been performed, the operator of the apparatus 1 can begin the extending movement of the same. This is performed by the operator using the hand crank 36 to drive the gearwheel 22, which engages in the intervals between the bolts 5 provided on the rigid-backed chain 3. The movement of the gearwheel 22 has the effect of guiding the bolts 5 along the guiding device 7, which is provided in the base plate 8. The extending movement has the effect of guiding the carriage 9, which at this stage of the bundling operation is locked to the rigid-backed chain 3, between the package 2 to be packaged and the ground B, along on the ground. The forward or extending movement of the rigid-backed chain 3 and, as a result, of the carriage 9, takes place until the stop 21, which is fastened on the length-limiting band 20, in turn fastened on the pushing part 11 of the carriage 9, hits a length-limiting stop 38, which is movable in the region of the base plate 8 and is represented only in FIG. 1, or the carriage is stopped in some other way, such as for example by means of a stopping block (not represented), which is arranged in a region at which the rigid-backed chain 3 is to be deflected.

The carriage 9 is prevented from being deflected inadvertently, as could happen during the extending movement (arrow 13), for example due to briefly higher pushing or sliding resistance of the carriage 9, by the pivot point (bolt 14) about which the deflecting unit 10 is pivoted being arranged at such a height above the carriage 9 that deflecting of the deflecting unit 10 requires a torque to be exerted by the rigid-backed chain 3, i.e. by the user driving the rigid-backed chain, of such a magnitude that can only be made available if the carriage 3 really is stationary.

The stop 21 allows the distance between it and the carriage 9, which is likewise fastened on the length-limiting band 20, to be set variably. The hitting of the stop 21 against the movable stop 38 causes the pushing part 11 of the carriage 9 to be stopped and held in this position. Since, however, the rigid-backed chain 3 and the deflecting unit 10 of the carriage 9, locked to the rigid-backed chain 3 at this point in time, have the tendency to continue the movement by further pushing of the rigid-backed chain 3, the deflecting unit 10 of the carriage 9, which unit is pivotably interconnected to the pushing part 11 of the carriage 9 only by means of the bolt 14, is deflected through approximately 90° with respect to the previous position, until it is is up against a stop 11*a* provided on the pushing part 11.

Since, because it is still being driven by means of the gearwheel 22 or the hand crank 36, the rigid-backed chain 3 has the tendency to continue the extending movement, the deflecting unit 10 of the carriage 9 is deflected through the already mentioned angle of approximately 90° about the bolt 14 as the pivot point, since the rigid-backed chain 3 is still locked to the deflecting unit. However, as soon as the deflecting unit 10 of the carriage 9 assumes the deflected position, the deflecting unit 10 is also virtually fixed in this position. The complete deflecting operation in this case proceeds without interrupting the extending movement of the rigid-backed chain 3.

In the normal position of the carriage 9 (deflecting unit not deflected), the support 24 prevents the blocking bolt 13 from jumping out of the slot 19, since an end face 30*a* of the blocking bolt 30 bears against the support 24, as represented in FIG. 4.

Since the deflecting unit 10 is fixed, the rigid-backed chain 3 is pushed further, whereby the lever 26, which until this stage of the bundling operation was resting on the tripping cam 18, presses the blocking bolt 30 out of the slot 19 and the bore 35 of the deflecting unit 10 by means of the helical spring 33, which has been pushed onto the attachment 32 of the blocking bolt 30 located in the region of the other end of the lever 26. As a result, the locking or connection between the deflecting unit 10 and the rigid-backed chain 3 is released.

The rigid-backed chain 3 and the packaging band 16, which is fastened on said chain by means of the clamping device 15 and is carried along in the rigid-backed chain 3, continue the extending movements and move along a path running at least approximately perpendicularly with respect to the ground on a side wall of the article 2 to be packaged. Tilting over of the rigid-backed chain 3 away from the article 2 to be packaged is prevented by the band-leading device 3 being designed as a rigid-backed chain. Tilting over of the rigid-backed chain 3 counter to this direction, i.e. in the direction toward the article 2 to be packaged, is prevented by the packaging band 16 being guided within the rigid-backed chain 3 behind cross-bolts (not represented) arranged transversely with respect to the direction of movement of the rigid-backed chain 3, i.e. on the side of the rigid-backed chain 3 facing away from the article 2 to be packaged, and being kept under tension during the extending movement (arrow 13) by the extending movement. As soon as the rigid-backed chain 3 protrudes a certain amount above the upper edge of the article 2 to be packaged and the tension of the packaging band 16 preventing tilting over toward the article to be packaged is released by a brief interruption in the extending movement, said chain tilts down onto the article 2 to be packaged, on account of the own weight of the front end of the rigid-backed chain 3, and, after a continuation of the extending movement, moves in a path which is then approximately horizontal on the upper side of the article 2 to be packaged, again toward the apparatus 1 or toward the user.

The user can then release the packaging band 16 from the clamping device 15 virtually without moving. This is performed simply by the user of the apparatus 1 gripping the packaging band 16 at its front end. As soon as this has taken place, the user can retract the rigid-backed chain again by turning the hand crank 36 in the then opposite direction. The retracting movement takes place on the same principle as the extending movement (arrow 13), to be specific by the gearwheel 22 engaging in the bolts 5 which are provided on the rigid-backed chain 3.

At the moment at which the front end of the rigid-backed chain 3 reaches the deflecting unit 10 of the carriage 9 during the retracting movement (arrow 12), the front, bent-away end of the lever 26 is pressed away from the rigid-backed chain by the tripping cam 18, and at the same time the blocking bolt 30, located at the other end of this lever 26, is inserted through the bore 35 of the deflecting unit 10 and ultimately also again through the slot 19 of the rigid-backed chain 3, whereby the rigid-backed chain 3 is again locked or connected to the deflecting unit 10 of the carriage 9 and ultimately also to the carriage 9.

The fact that the deflecting unit 10 remains in the deflected position until, during the retracting operation, the locking between the rigid-backed chain 3 and the carriage 9 is completed, and the deflecting unit 10 of the carriage 9 is bearing against the article to be packaged, has the effect of preventing the carriage 9 from being drawn along before this locking operation, in an unlocked state, by the retracting movement (arrow 12) under the article 2 to be packaged, as a result of which the next packaging operation would not be possible.

Furthermore, the fact that the blocking bolt 30 is no longer projecting, and as a result is also no longer resting on the support 24, has the effect that the deflecting unit 10 is no longer held in the deflected position and the deflecting unit 10 pivots back virtually automatically of its own accord as a result of the retracting movement of the rigid-backed chain 3. The further movement of the hand crank 36 causes a continuation of the retracting movement (arrow 12) of the rigid-backed chain 3 and of the carriage 9, arranged on said chain, up to the position in which the actual bundling operation was begun.

During the retracting movement, the rigid-backed chain 3 is guided virtually along the packaging band 16, which is firmly held by the user during the retracting operation. This has the advantage that the packaging band 16 no longer has to be re-threaded into the rigid-backed chain 3 in a new packaging operation. This only becomes necessary if there is no more packaging band 16 on the band roller 37.

As soon as the rigid-backed chain 3, and consequently also the carriage 9, are back in the starting position, the user can conclude the packaging operation by joining together the front end and the end located in the region of the band roller 37 of the packaging band 16.

In the region of the base plate 8, the guiding device 7 is designed at the retracting and extending regions of said device in such a way that the T groove opens virtually conically in the direction of the extending movement. This measure ensures functionally dependable extending and retracting of the rigid-backed chain 3 or of the bolts 5 arranged on the same. This configuration of the T groove allows the carriage 9 to be extended at different heights, since the rigid-backed chain 3 is no longer guided in a fixed path, but rather in a certain region, in the extending and retracting regions of the T groove, and the carriage 9 is consequently flexible with respect to its extending height or the distance of the carriage 9 from the ground B.

What is more, wheels intended to facilitate manual transport are also provided on the apparatus 1. Furthermore, a transporting lever 41 is provided in the region of the base plate 8 of the apparatus 1 and is likewise intended to facilitate manual transporting of the apparatus 1. This transporting lever 41 is designed in this case in such a way that it can be swung in during the bundling operation. Swinging in of this transporting lever 41 avoids it projecting and being able to injure persons or the user.

It goes without saying that the packaging operation described above can also be performed in the reverse sequence. In this case, the packaging band 16 is fastened with the aid of the clamping device 15 to the front end of the rigid-backed chain 3 in the extended position of the rigid-backed chain 3 and the packaging band 16 is passed around the article 2 to be strapped during the retracting movement (arrow 12).

What is claimed is:

1. An apparatus which can be manually operated and transported, for strapping pallets and articles, comprising:

at least one base plate, having a band guide, which is designed as a rigid-backed chain, and having at least one clamping device, arranged at the front end of said rigid-backed chain, wherein a guiding device (7), in which said chain (3) is guided, is provided on the base plate (8), wherein a carriage (9), on which there is fastened a length-limiting band (20) which can be fixed to the base plate (8), is releasably attached to the front end of said chain (3), wherein the carriage (9) is taken along by the said chain (3) over a distance allowed by the length-limiting band (20), and wherein the carriage (9) has a deflecting unit (10), by which said chain (3) is deflected upward during its further advancement by the pushing force of said unit, after which it becomes detached from the carriage (9).

2. The apparatus as claimed in claim 1, wherein the guiding device (7) provided in the at least one base plate (8) defines a groove.

3. The apparatus as claimed in claim 2, wherein said rigid-backed chain (3) is guided in the guiding device (7) by means of bolts (5) respectively provided with an incision (6) on a circumference thereof.

4. The apparatus as claimed in claim 2, wherein said rigid-backed chain (3) is arranged between two base plates (8*a*, 8*b*), connected to each other by means of spacers (42), and is guided in grooves (7*a*, 7*b*) within in the base plates (8*a*, 8*b*).

5. The apparatus as claimed in claim 2, wherein the groove made in said one base plate (8) follows a spiral path on the base plate (8).

6. The apparatus as claimed in claim 2, wherein the groove (7) includes a conically tapering retracting region and extending region.

7. The apparatus as claimed in claim 1, wherein the carriage (9) comprises a locking mechanism (35) for connecting and releasing the same with respect to said chain (3).

8. The apparatus as claimed in claim 1, wherein a tripping cam (18) is fastened on a front end of the rigid-backed chain (3), by which said cam, on the one hand, enables a connection between the deflecting unit (10) and the rigid-backed chain (3) and is released and, on the other hand, the rigid-backed chain (3) is connected to the deflecting unit (10) of the carriage (9).

9. The apparatus as claimed in claim 1, wherein the deflecting unit (10) is connected pivotably to a pushing part (11) of the carriage (9) by means of a bolt (14) arranged transversely with respect to the direction of movement.

10. The apparatus as claimed in claim 1, wherein a lever (26) mounted for pivoting about bolts (28) arranged between its two ends is arranged on the deflecting unit (10).

11. The apparatus as claimed in claim 10, wherein a blocking bolt (30) is arranged pivotably at one end of the lever (26) by means of a bolt (31).

12. The apparatus as claimed in claim 11, wherein the blocking bolt (30) includes an attachment (32), over which a helical spring (33) is disposed.

13. The apparatus as claimed in claim 11, wherein a side wall (34) of the deflecting unit (10) includes a bore (35) arranged transversely with respect to the direction of movement of said rigid-backed chain (3) as a guide for the blocking bolt (30), into which it can be pushed for locking of said chain (3).

14. The apparatus as claimed in claim 11, wherein the deflecting unit (10) includes a support (24) fastened laterally on it, preventing the blocking bolt (30) from escaping from said rigid-backed chain (3) before deflection thereof.

15. The apparatus as claimed in claim 1, wherein the rigid-backed chain (3) is provided in its front region with a slot (19).

16. The apparatus as claimed in claim 1, wherein said clamping device (15) by which a packaging band (16) is fixed on said rigid-backed chain (3) before the beginning of a bundling operation, is arranged at the front end of said chain (3).

17. The apparatus as claimed in claim 1, wherein said rigid-backed chain (3) is moved by means of a gearwheel (22) mounted in the base plate (8).

18. The apparatus as claimed in claim 1, wherein the carriage (9) is formed by the deflecting unit (10) and a pushing unit (11), the pushing unit (11) of the carriage (9) having a skid part (23).

19. The apparatus as claimed in claim 18, wherein an end of the skid part (23) points in a direction of an extending movement of said chain (3) and an end of the skid part (23) points in a direction of a retracting movement of said chain (3) pointing away from the ground.

20. The apparatus as claimed in claim 1, wherein a band roller (37) with packaging band (16) wound up on it, is provided in the region of the base plate (8).

* * * * *